US008093522B2

(12) United States Patent
Cheng

(10) Patent No.: US 8,093,522 B2
(45) Date of Patent: Jan. 10, 2012

(54) PRESS-BUTTON FOR ELECTRONIC DEVICE

(75) Inventor: Da-Qing Cheng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 430 days.

(21) Appl. No.: 12/327,634

(22) Filed: Dec. 3, 2008

(65) Prior Publication Data

US 2009/0308723 A1 Dec. 17, 2009

(30) Foreign Application Priority Data

Jun. 13, 2008 (CN) ..... 2008 1 0302131

(51) Int. Cl.
*H01H 3/12* (2006.01)

(52) U.S. Cl. ..... 200/341; 200/344

(58) Field of Classification Search ..... 200/341, 200/344, 345, 534, 535
See application file for complete search history.

(56) References Cited

U.S. PATENT DOCUMENTS 4,638,151 A * 1/1987 Suwa ..... 235/145 R
4,778,952 A * 10/1988 Watkins et al. ..... 200/5 A

FOREIGN PATENT DOCUMENTS

CN 1988086 A 6/2007

* cited by examiner

*Primary Examiner* — Elvin G Enad
*Assistant Examiner* — Lisa Klaus
(74) *Attorney, Agent, or Firm* — Altis Law Group, Inc.

(57) ABSTRACT

An exemplary press-button for an electronic device, includes a button cap, a support member connected to the button cap, and a resilient member positioned between the button cap and the support member. The button cap includes a pressing portion extending from a middle portion. The resilient member includes a main portion abutting the support member and a plurality of extending pieces uniformly extending from an edge of the main portion. Each extending piece includes a resisting portion for abutting the button cap and a deformable portion connected between the resisting portion and the main portion.

17 Claims, 3 Drawing Sheets

PRESS-BUTTON FOR ELECTRONIC DEVICE

BACKGROUND

1. Technical Field

The present disclosure relates to a press-button for an electronic device.

2. Description of the Related Art

Electronic devices such as computers generally employ press-buttons power switches. Controlling the accuracy or reliability of a press-button is important for an electronic device.

A typical press-button includes a pressing member, a contact piece, and a stationary contact. The pressing member includes a protrusion extending from a middle portion of a lower end of the pressing member. The contact piece is an arched resilient piece positioned between the protrusion of the pressing member and the stationary contact. The protrusion of the pressing member abuts the contact piece. When an external force is applied to the pressing member, the protrusion presses the contact piece to deform and contact the stationary contact. When the external force is removed, an elastic force created by the contact piece pushes the pressing member to return to an original position. The typical press-button may further include a spring sleeved on the protrusion. The spring is configured to support the pressing member and create an elastic force for helping the pressing member to reset.

However, the protrusion of the typical press-button extends from the middle portion of the lower end of the pressing member, so that the spring is also positioned on the middle portion of the lower end of the pressing member. In order to operate the press-button accurately, the external force should be applied on a middle portion of an upper end of the pressing member. If the external force is not applied to the middle portion, the spring and the protrusion of the pressing member may not sufficiently press the contact piece. Thus, the contact piece cannot contact the stationary contact accurately. In addition, the spring may be latched by the protrusion and cannot return to a normal state to reset the pressing member. Therefore, the controlling accuracy or the reliability of the typical press-button is relatively low, and a pressing sense of operating the press-button may be uncomfortable.

Therefore, a new press-button for electronic device is desired to overcome the above-described shortcomings.

BRIEF DESCRIPTION OF THE DRAWINGS

The components in the drawings are not necessarily drawn to scale, the emphasis instead being placed upon clearly illustrating the principles of the present press-button. Moreover, in the drawings, like reference numerals designate corresponding parts throughout the several views.

DETAILED DESCRIPTION

Figure 1:
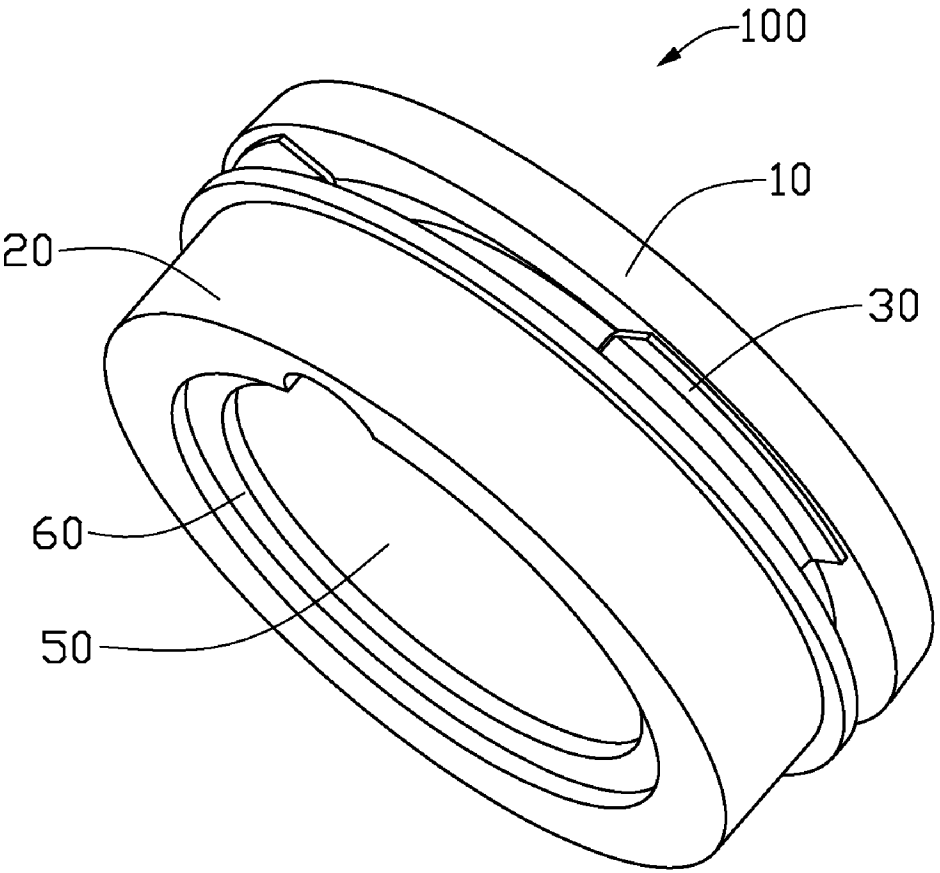
FIG. 1 is an assembled, isometric view of an embodiment of a press-button.
Figure 2:
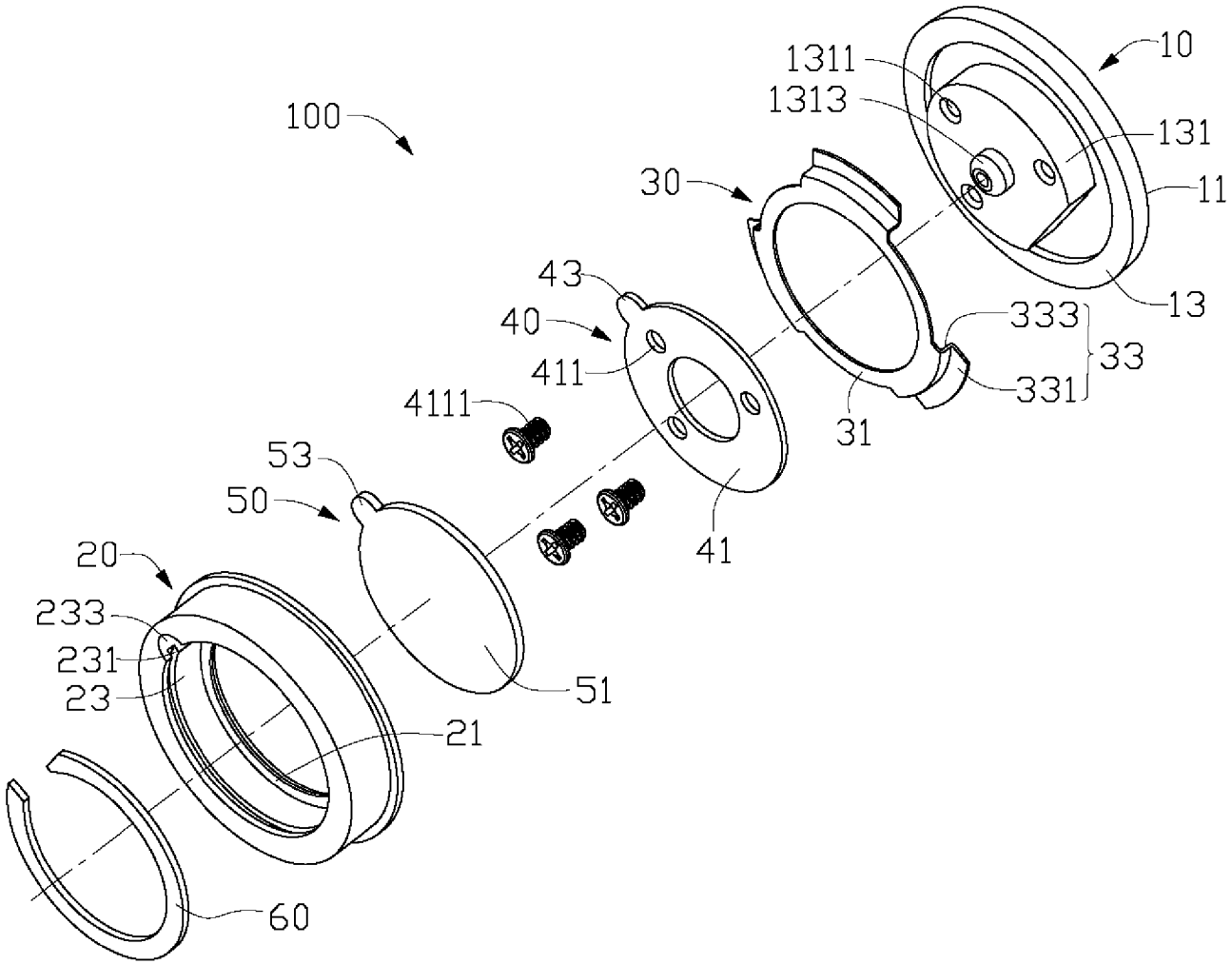
FIG. 2 is an exploded, isometric view of the press-button of FIG. 1.

Referring to FIGS. 1 and 2, an embodiment of a press-button 100 includes a button cap 10, a support member 20, a resilient member 30 positioned between the button cap 10 and the support member 20, a fixing washer 40 positioned in the support member 20, a circuit board 50, and a clip 60.

The button cap 10 includes an upper end 11 and a lower end 13 opposite the upper end 11. The lower end 13 is substantially annular and configured for abutting the resilient member 30. The button cap 10 further includes a platform 131 extending from a middle portion of the lower end 13. The platform 131 is substantially cylindrical and defines a plurality of threaded holes 1311. A pressing protrusion 1313 is formed on a middle portion of the platform 131.

The support member 20 is substantially cylindrical. An inner flange 21 is formed on a first end of the support member 20. The support member 20 defines an annular groove 231 in an inner wall 23 adjacent to a second end of the support member 20 and a restricting groove 233 in the inner wall 23. The restricting groove 233 extends along a direction parallel to a central axis of the support member 20 and communicates with the annular groove 231.

The resilient member 30 includes a main portion 31 and a plurality of extending pieces 33 uniformly extending from an edge of the main portion 31. The main portion 31 is substantially annular shaped and can be sleeved on the platform 131 of the button cap 10. In the illustrated embodiment, the plurality of extending pieces 33 comprises three extending pieces. Each extending piece 33 includes a resisting portion 331 for abutting the lower end 13 of the button cap 10 and a deformable portion 333. A first end of the deformable portion 333 extends substantially perpendicularly from the main portion 31 and the resisting portion 331 extends substantially perpendicularly from a second end of the deformable portion 333, such that the main portion 31 is substantially parallel to the resisting portion 331.

The fixing washer 40 includes an annular portion 41 and a tab 43 extending from an edge of the annular portion 41. The annular portion 41 defines a plurality of through holes 411 corresponding to the threaded holes 1311 of the button cap 10.

The circuit board 50 includes a base portion 51 and a tab 53 extending from an edge of the base portion 51. A deformable contact piece 511 (shown in FIG. 3) and a stationary contact 513 (shown in FIG. 3) corresponding to the deformable contact piece 511 are fixed on the base portion 51. A cross-section of the deformable contact piece 511 is substantially arched in shape. The deformable contact piece 511 and the stationary contact 513 are spaced from each other in an original state. The deformable contact piece 511 and the stationary contact 513 are correspondingly connected to different electrodes (not shown).

The clip 60 is substantially a C-shaped ring and configured for being latched in the annular groove 231 of the support member 20.

Figure 3:
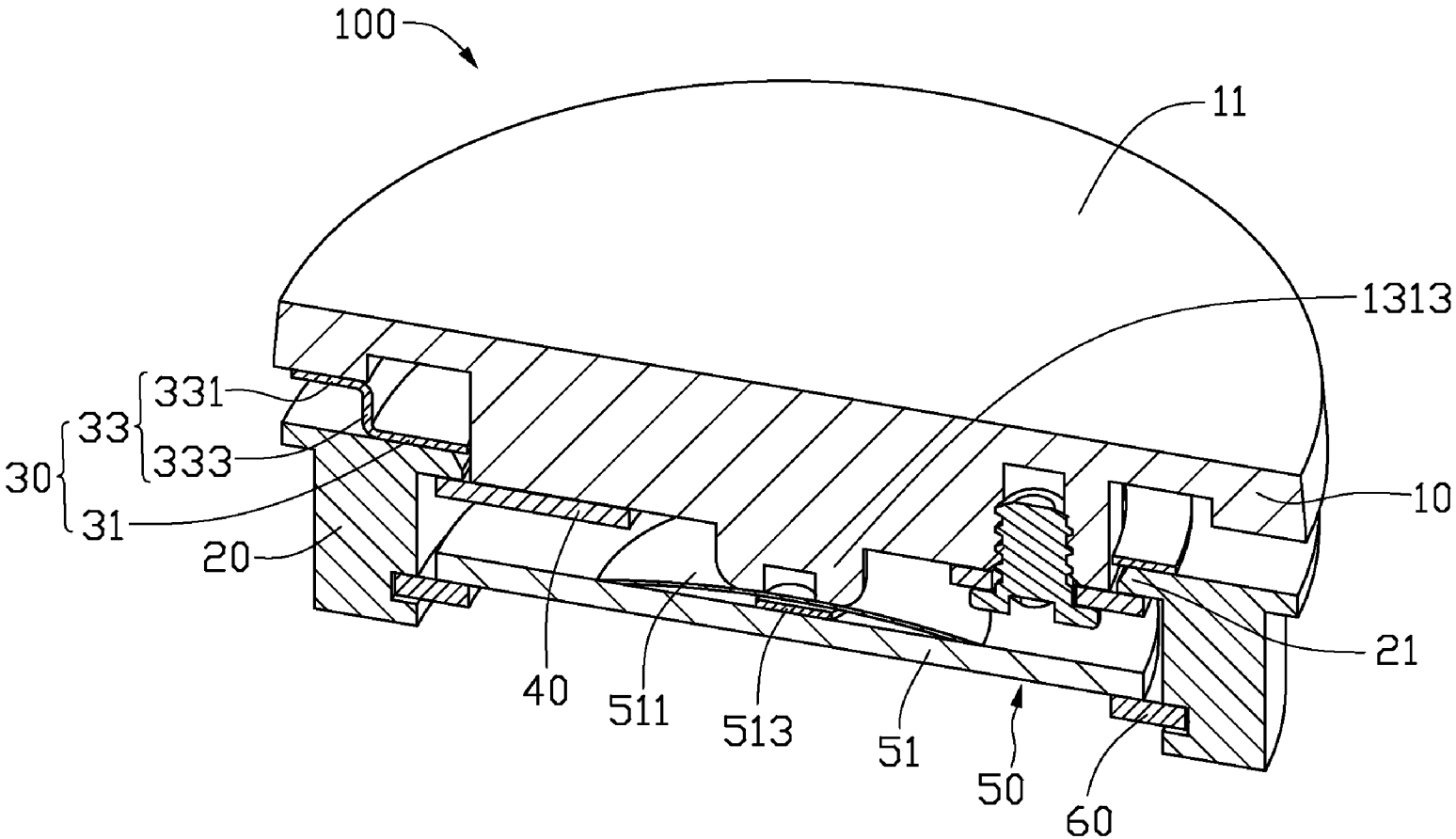
FIG. 3 is a side, cross-sectional view of the press-button of FIG. 1.

Referring also to FIG. 3, the main portion 31 of the resilient member 30 is sleeved on the platform 131 of the button cap 10, with the resisting portions 331 of the extending pieces 33 abutting the lower end 13 of the button cap 10. The platform 131 of the button cap 10 is partially inserted into the support member 20 from the first end of the support member 20. The fixing washer 40 is positioned in the support member 20 from the second end of the support member 20 and the pressing portion 1313 of the button cap 10 extends through the annular portion 41 of the fixing washer 40. The tab 43 of the fixing washer 40 is latched in the restricting groove 233, thus preventing the fixing washer 40 from rotating relative to the support member 20. A plurality of fixing members 4111 such as screws engage in the through hole 411 and the threaded holes 1311 of the button cap 10, thereby connecting the fixing washer 40 to the button cap 10. The fixing washer 40 abuts the inner flange 21 of the support member 20, so that the inner flange 21 of the support member 20 can prevent the fixing washer 40 and the button cap 10 from detaching from the support member 20. The circuit board 50 is received in the support member 20, with the tab 53 latched in the restricting groove 233, to prevent the circuit board 50 from rotating relative to the support member 20. The clip 60 is latched in the annular groove 231 of the support member 20, thereby fixing and supporting the circuit board 50 in the support member 20.

When an external force is applied on the upper end 11 of the button cap 10, the lower end 13 presses the resisting portions 331 of the extending pieces 33 of the resilient member 30. Accordingly, the deformable portion 333 of each extending piece 33 deforms to decrease a height of the deformable portion 333, thereby decreasing a total height of the resilient member 30. As a result, the pressing protrusion 1313 of the platform 131 of the button cap 10 presses the deformable contact piece 511 against the stationary contact 513, thereby turning the press-button on. When the external force is removed from the upper end 11 of the button cap 10, the deformable portion 333 of each extending piece 33 returns to an original position and the extending pieces 33 pushes the button cap 10 to an original position.

The extending pieces 33 uniformly extend from the edge of the main portion 31 of the resilient member 30, so that each of the extending pieces 33 deforms simultaneously to turn on the press-button 100 when a middle portion of the button cap 10 is pressed by the external force. The extending pieces 33 are capable of operatively resetting the button cap 10 when the middle portion of button cap 10 is not pressed. If the external force is not applied on the middle portion of the button cap 10, the external force can also be distributed to the extending pieces 33, so that each of the extending pieces 33 also deform simultaneously to turn on the press-button 100. Therefore, even if the external force is not accurately applied on the middle portion of the button cap 10, the button cap 10 and the resilient member 30 are still capable of moving simultaneously so that a controlling accuracy or reliability of the press-button 100 is relatively high. In addition, because the external force can be distributed to the extending pieces 33, a pressing sense of operating the press-button 100 is comfortable.

It may be appreciated that the main portion 31 of the resilient member 30 is not limited to being annular shaped, but may be other shapes such as rectangular shaped. The support member 20 may also be a rectangular barrel. In addition, the fixing washer 40 may be connected to the button cap 10 by other means such as riveting, welding, or adhesive bonding technique.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A press-button, comprising:

a button cap having a pressing portion extending from a middle portion thereof;

a support member connected to the button cap; and a resilient member positioned between the button cap and the support member, the resilient member comprising a main portion abutting the support member and a plurality of extending pieces uniformly extending from an edge of the main portion, each extending piece comprising a resisting portion for abutting the button cap and a deformable portion connected between the resisting portion and the main portion;

a circuit board positioned in the support member, the circuit board comprising a deformable contact piece and a stationary contact corresponding to the deformable contact piece; the pressing portion of the button cap being capable of pressing the deformable contact piece against the stationary contact when the resilient member is pressed by the button cap;

wherein the support member defines an annular groove in a side wall; the press-button further comprises a clip latched in the annular groove to fix the circuit board in the support member.

2. The press-button of claim 1, wherein a cross-section of the deformable contact piece is substantially arched in shape.

3. The press-button of claim 1, wherein the main portion of the resilient member is substantially annular shaped.

4. The press-button of claim 3, wherein the button cap comprises an upper end and a lower end opposite the upper end, the lower end is substantially annular and configured for abutting the main portion of the resilient member.

5. The press-button of claim 4, wherein the button cap further comprises a platform extending from a middle portion of the lower end, and the pressing protrusion is formed on a middle portion of the platform.

6. The press-button of claim 5, wherein the platform is substantially cylindrical.

7. The press-button of claim 5, further comprising a fixing washer positioned in the support member and fixed to the platform of the button cap.

8. The press-button of claim 7, wherein the fixing washer comprises an annular portion and a tab extending from an edge of the annular portion; the pressing portion of the button cap extends through the annular portion; the support member defines a restricting groove in a side wall; the tab is latched in the restricting groove to prevent the fixing washer from rotating relative to the support member.

9. The press-button of claim 8, wherein a plurality of threaded holes is defined in the platform; the annular portion of the fixing washer defines a plurality of through hole corresponding to the threaded holes; the press-button further comprises a plurality of fixing members engaging in the through hole and the threaded holes.

10. A press-button, comprising:

a button cap having a platform extending from a middle portion of a lower end thereof, and a pressing protrusion formed on a middle portion of the platform;

a support member connected to the button cap;

a resilient member positioned between the button cap and the support member, the resilient member comprising a main portion abutting the support member and three extending pieces uniformly extending from an edge of the main portion, each extending piece comprising a resisting portion for abutting the button cap and a deformable portion connected between the resisting portion and the main portion; and a circuit board positioned in the support member, comprising a deformable contact piece and a stationary contact corresponding to the deformable contact piece, wherein the pressing portion is capable of pressing the deformable contact piece against the stationary contact when the resilient member is pressed by the button cap;

wherein the support member defines an annular groove in a side wall; the press-button further comprises a clip latched in the annular groove to fix the circuit board in the support member.

11. The press-button of claim 10, wherein the main portion of the resilient member is substantially annular shaped; the lower end is substantially annular and configured for abutting the main portion of the resilient member.

12. The press-button of claim 10, wherein the platform is substantially cylindrical.

13. The press-button of claim 10, wherein a cross-section of the deformable contact piece is substantially arched in shape.

14. The press-button of claim 10, further comprising a fixing washer positioned in the support member and fixed to the platform of the button cap.

15. The press-button of claim 14, wherein the fixing washer comprises an annular portion and a tab extending from the annular portion; the pressing portion extends through the annular portion; the support member defines a restricting groove in a side wall; the tab is latched in the restricting groove to prevent the fixing washer from rotating in the support member.

16. The press-button of claim 15, wherein a plurality of threaded holes is defined in the platform; the annular portion of the fixing washer defines a plurality of through hole corresponding to the threaded hole; the press-button further comprises a plurality of fixing members engaging in the through hole and the threaded holes.

17. The press-button of claim 15, wherein the support member is substantially cylindrical, and comprises an inner flange formed on an end thereof; the fixing washer abuts the inner flange.

* * * * *